US005740906A

United States Patent [19]

Lai

[11] Patent Number: 5,740,906

[45] Date of Patent: Apr. 21, 1998

[54] CONTAINER COMBINATION FOR STATIONERY GOODS

[76] Inventor: Yung-feng Lai, 1st Fl., No. 4, Lane 328, Sec. 2, Chungshan Rd., Chungho City, Taipei Hsien, Taiwan

[21] Appl. No.: 693,519

[22] Filed: Aug. 8, 1996

[51] Int. Cl.[6] ..... A45C 11/34

[52] U.S. Cl. ..... 206/214; 206/371; 206/581; 220/4.27; 312/107

[58] Field of Search ..... 206/214, 224, 206/371, 215, 581, 6.1; 220/4.27, 23.83; 312/107, 308, 326

[56] References Cited

U.S. PATENT DOCUMENTS

| | | | |
|---|---|---|---|
| 4,549,664 | 10/1985 | Gowan et al. | 312/308 |
| 4,753,346 | 6/1988 | Tsuji | 206/371 |
| 4,815,483 | 3/1989 | DuGrenier et al. | 220/4.27 |
| 4,953,696 | 9/1990 | Huang et al. | 206/214 |
| 5,134,918 | 8/1992 | Chang | 206/214 |
| 5,246,020 | 9/1993 | Wu | 206/581 |
| 5,417,329 | 5/1995 | Whitman | 220/4.27 |

*Primary Examiner*—Paul T. Sewell
*Assistant Examiner*—Nhan T. Lam
*Attorney, Agent, or Firm*—Hedman, Gibson & Costigan, P.C.

[57] ABSTRACT

A container combination for stationery goods. The container combination comprises a base plate, a central container assembly provided on the base plate, a lateral container assembly provided on the base plate adjacent to one side of the central container assembly, a bookend assembly provided on the base plate adjacent to another side of the central container assembly, and a post assembly. The height of each of the central container assembly and the lateral container assembly can be increased without being restricted by an upper limit.

17 Claims, 6 Drawing Sheets

CONTAINER COMBINATION FOR STATIONERY GOODS

FIELD OF THE INVENTION

The present invention relates to a container combination for stationery goods, particular relates to a multi-function container combination for stationery goods in which the number of containers may increase without being restricted by an upper limit.

BACKGROUND OF THE INVENTION

Containers for stationery goods such as writing instruments, scissors, paper clips, staples, knifes, erasers, note paper and keys are necessary in daily office work. However, because conventional containers for stationery goods, for example, containers for writing instruments or various kinds of boxes, either have only one receiving cavity, which results in the fact that the stationery goods in the container are untidily clumped together in a mass, or are not specially designed for multi-functions, these containers do not meet the utility requirements of practical situations. Besides, in a conventional container, the existing space is fixed and may not be changed. Therefore, when the amount of stationery goods is increased while the existing cavity in a container is not enough, or when a large area for accommodating a big container is not available, the defects of a conventional container become very obvious.

Hence, there exists a need for an improved container combination for stationery goods to overcome the above-mentioned defects of conventional containers for stationery goods.

SUMMARY OF THE INVENTION

From the foregoing, it should be clear that the object of the present invention is to provide a container combination for stationery goods which overcomes the defects of conventional containers for stationery goods.

One way to achieve the above-mentioned object is to provided a container combination for stationery goods in accordance with the present invention in which the number of containers may increase without having an upper limit.

In accordance with the present invention, the container combination mainly comprises a base plate, a central container assembly provided on the base plate, a lateral container assembly provided on the base plate adjacent to one side of the central container assembly, a bookend assembly provided on the base plate adjacent to another side of the central container assembly, and a post assembly.

In accordance with one aspect of the present invention, the central container assembly includes at least one second assembling frame. The assembling frames have top and bottom openings and have at least one joint means for stacking up one on top of another to form a peripheral side wall of the central container assembly. The bottom assembling frame can be made attachable to the base plate or be formed integral with the base plate. An attachment means is provided on a rear side wall of a assembling frames of the central container assembly for attachment of the hanging post assembly. A movable support crossbar spans two opposite side walls of the top assembling frame. A plurality of separating plates intersecting with each other are provided in an assembling frame.

In accordance with another aspect of the present invention, the lateral container assembly includes a plurality of containers. These containers each have an open top and have pivoting means for stacking up on and pivoting with another one around an axis perpendicular to the base plate. The bottom container can be made attachable to the base plate or be formed integral with the base plate. An enclosure lid is disposed on the top container. The enclosure lid comprises pivoting means near a bottom edge thereof for pivoting around the pivoting means of the top container.

In accordance with still another aspect of the present invention, a space exists between the central container assembly and the lateral container assembly for placing note paper therein.

In accordance with one further aspect of the present invention, the hanging post assembly includes a main bar attachable to the attachment means of the central container assembly, at least one hook disposed on an upper portion of the main bar, a block portion protruding from a middle portion of the main bar for holding the hanging post assembly a suitable position, and a screw partly extended through a face of the main bar.

In accordance with yet another aspect of the present, the relative positions of the bookend assembly, the central container assembly, and the lateral container assembly can be arranged in more than one way.

In accordance with still another aspect of the present, the bookend assembly includes an L-shaped movable plate having a vertical portion and a horizontal portion received in a receiving means of the base plate. A bottom plate is attached by means of screws to a bottom of the base plate to secure the horizontal portion in the receiving recess. A coil spring is disposed between the horizontal portion and the base plate to urge the vertical portion to an edge of the base plate or to a side wall of the central container assembly. A stop block projects from the receiving recess of the base plate and a slot for receiving the stop block is provided on the horizontal portion of the movable plate for disposing the coil spring therebetween.

Other objects, advantages and novel features of the present invention will become more apparent from the following detailed description when taken in conjunction with the accompanying drawings.

DETAILED DESCRIPTION OF PREFERRED EMBODIMENT

Figure 1:
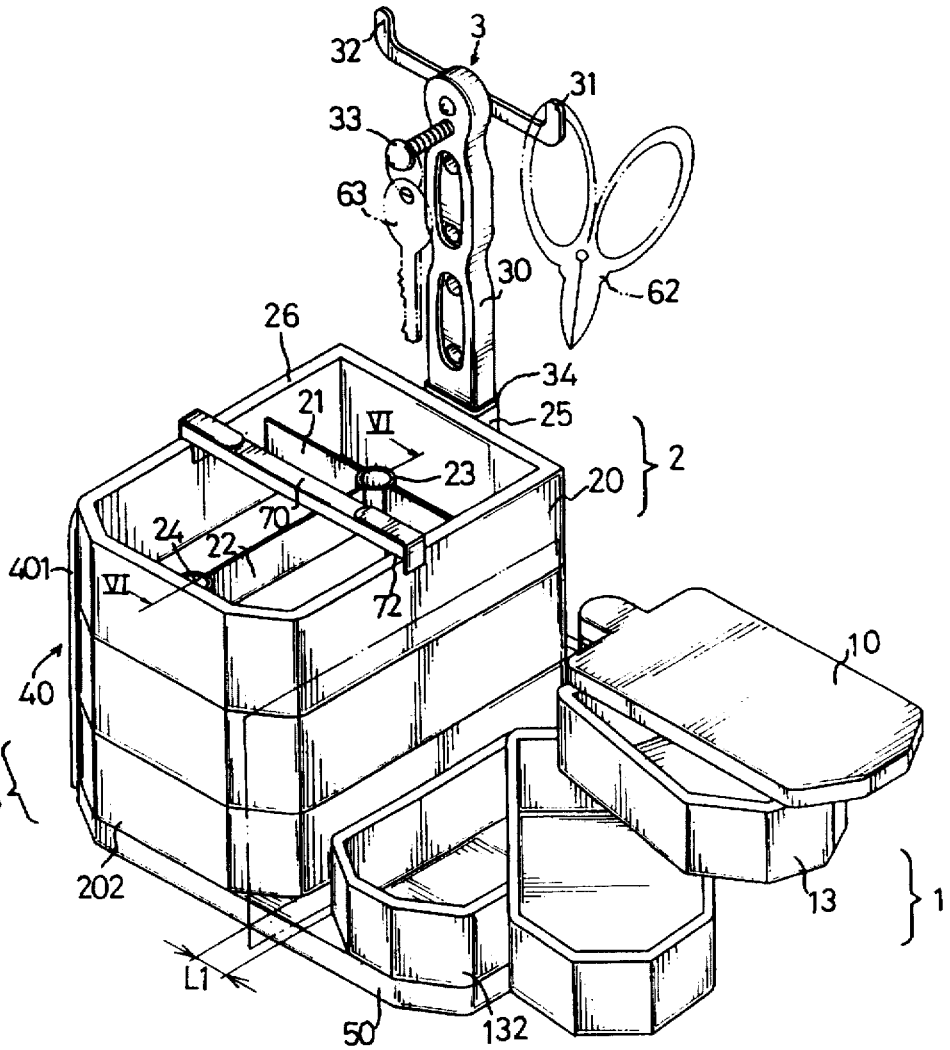
FIG. 1 is a perspective view of an embodiment of a container combination for stationery goods in accordance with the present invention.
Figure 2:
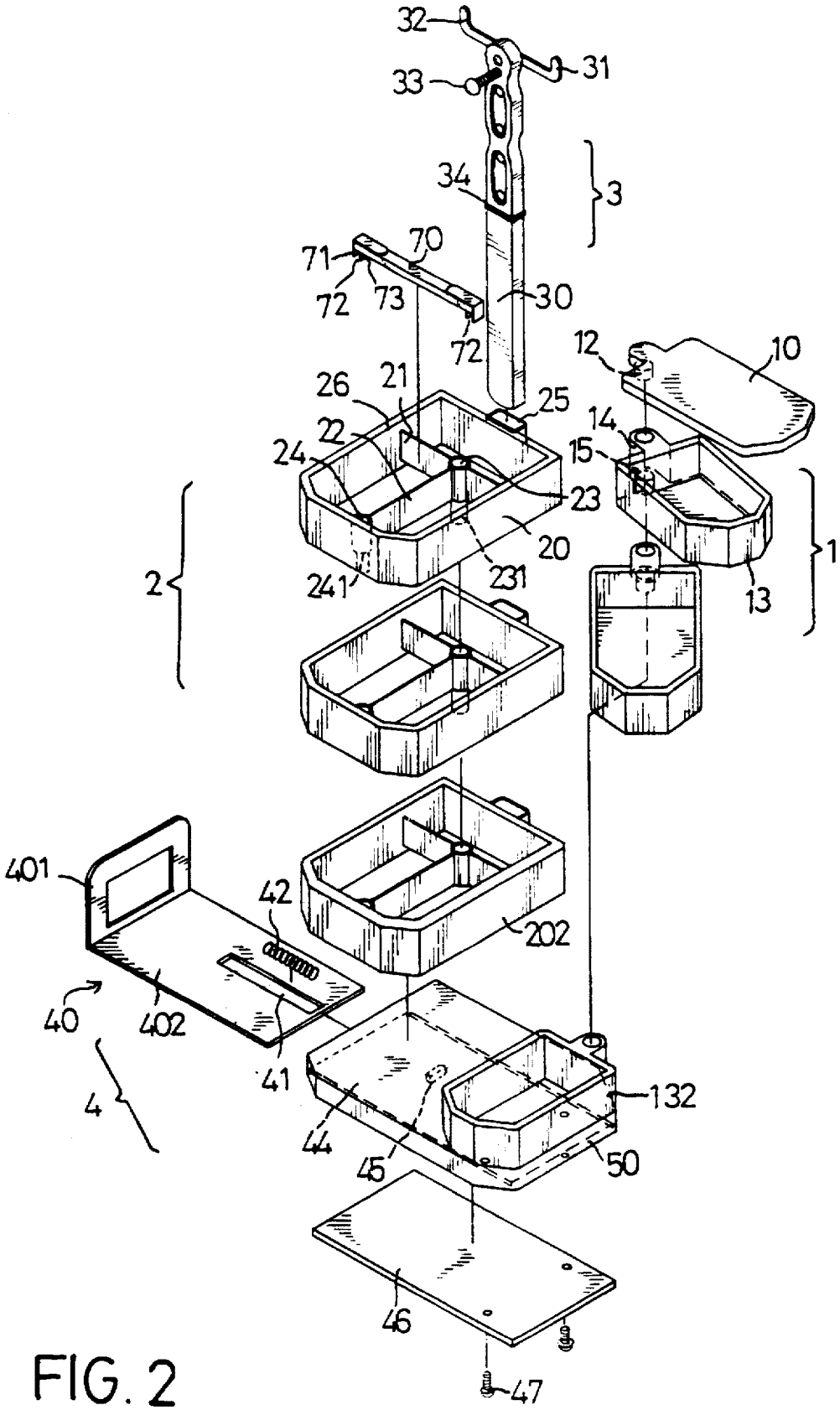
FIG. 2 is an exploded view of the container combination for stationery goods of FIG. 1.

Referring to FIGS. 1 and 2, an embodiment of a container combination for stationery goods in accordance with the present invention comprises a base plate 50, a central container assembly 2 provided on the base plate 50, a lateral container assembly 1 provided on the base plate 50 and besides the central container assembly 2, a bookend assembly 4 provided on the base plate 50 and abutting another side of the central container assembly 2, and a post assembly 3 attached on the rear side wall of the central container assembly 2 for hanging articles.

Figure 3:
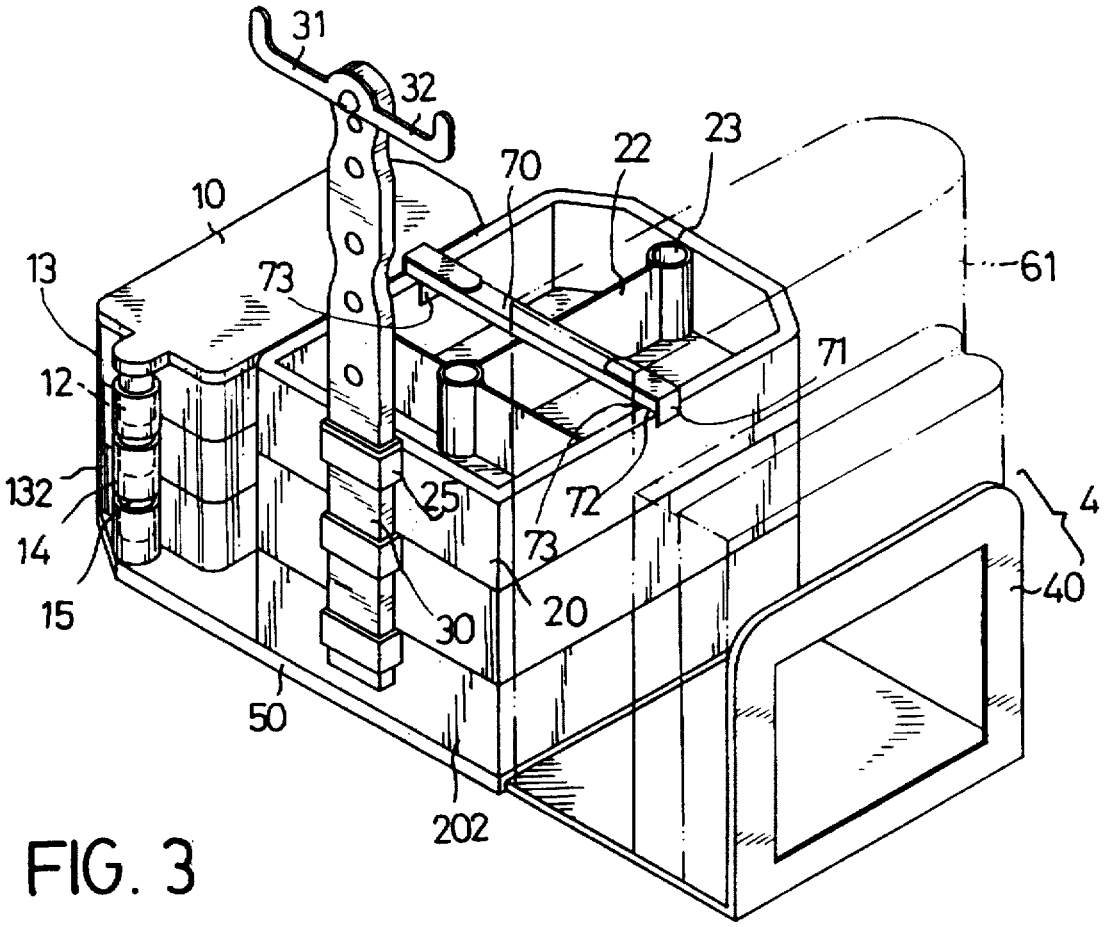
FIG. 3 is a perspective view from the rear side of the present container combination for stationery goods.
Figure 6:
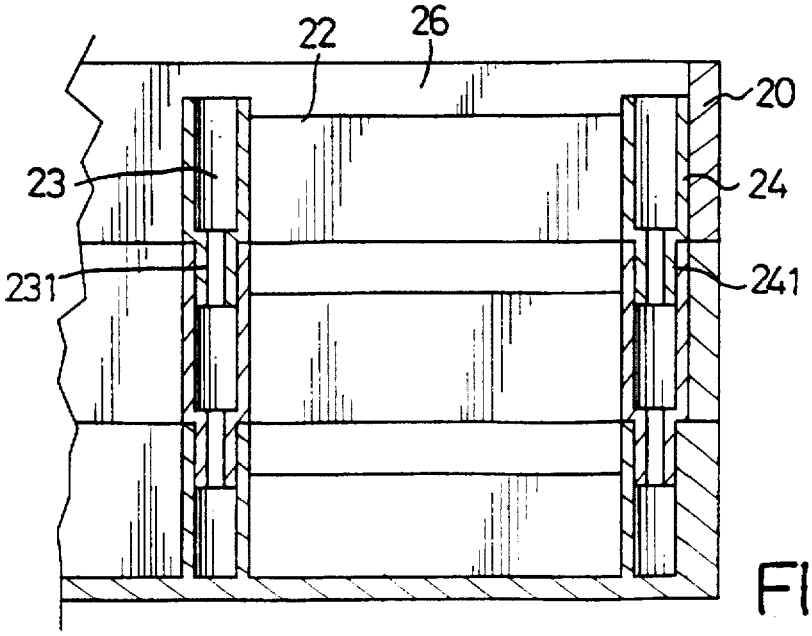
FIG. 6 is a longitudinal cross-sectional view of the present container combination for stationery goods taken along line VI—VI of FIG. 1 with the removable support crossbar removed.
Figure 8:
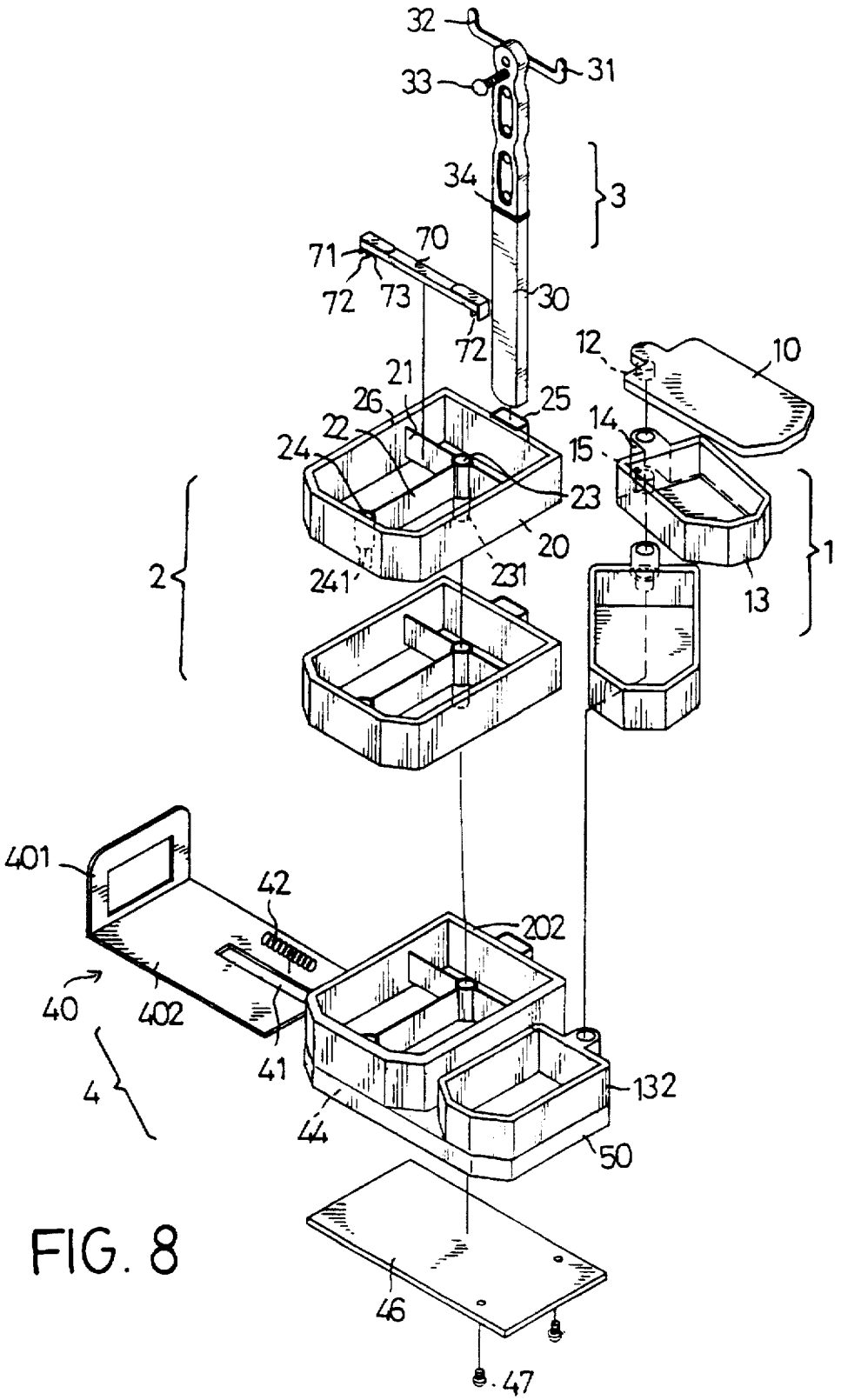
FIG. 8 is a perspective view of another embodiment of a container combination for stationery goods in accordance with the present invention.

As can be seen in FIGS. 1, 2 and 3, the central container assembly 2 includes a plurality of assembling frames 20, 202 stacked up on the base plate 50. The assembling frames have top and bottom openings. The assembling frames may take any shape; for example, a square, a rectangle, or a polygon, etc. Each of the assembling frames comprises at least one joint means for stacking up one on top of another. The joint means of each assembling frame except the bottom assembling frame 202 may comprise a ring portion defining a receiving hole therein and a plug (see FIG. 2) protruding downwardly from a bottom of the ring portion for being received in a receiving hole of an assembling frame beneath it so that the assembling frames stack up in a secure manner to form a peripheral side wall 26 of the central container assembly 2 for receiving writing instruments and other rod-shaped stationery goods therein. In the present embodiment, there are two receiving hole 23, 24 with plugs 231, 241, respectively. The joint means of the bottom assembling frame 202 may comprise a ring portion defining a receiving hole therein but has no protrusion on the bottom of its ring portion. The joint between two assembling frames can be best seen in FIG. 6. The bottom assembling frame 202 can be attached to the base plate 50 by means commonly known to persons skilled in the art. Also, the bottom assembling frame may be formed integral with the base plate 50, as shown in FIG. 8.

In the central container assembly 2, at least one of the assembling frames has attachment means on a rear side wall thereof for attachment of the hanging post assembly 3.

Figure 4:
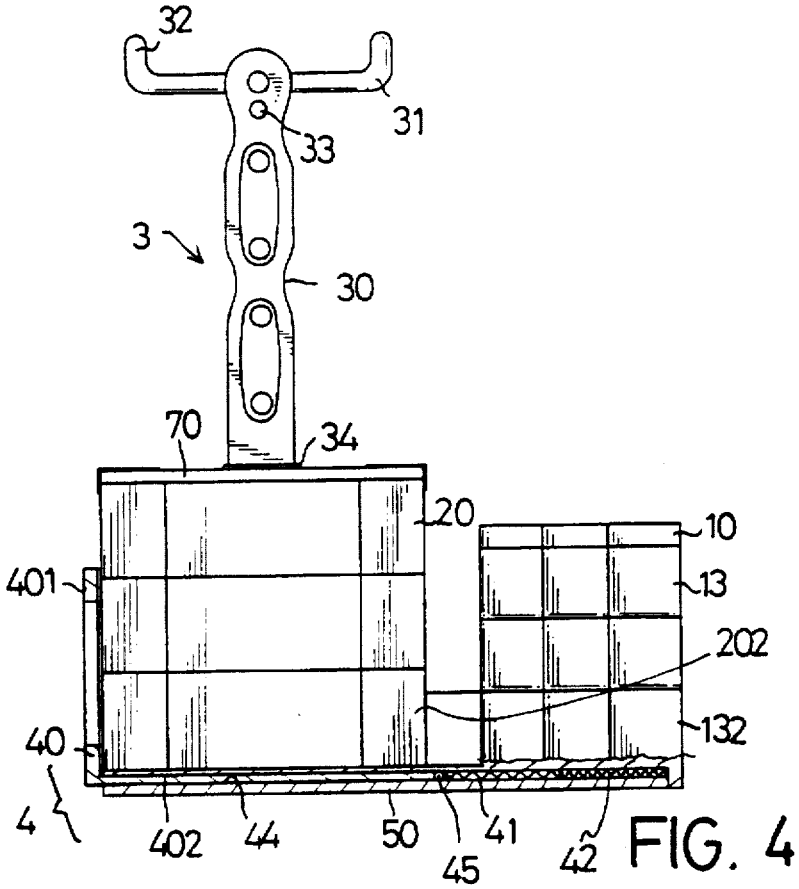
FIG. 4 is a front view of the present container combination for stationery goods.

The hanging post assembly 3 may include a main bar 30 attachable to the attachment means of the central container assembly 2 in a way commonly known to persons skilled in the art. At least one hook may be disposed on an upper portion of the main bar 30 for hanging items thereon. In the embodiment shown in FIG. 1, a pair of hooks 31, 32 are provided on the main bar 30 with a pair of scissors 62 hanging thereon. A screw 33 may be partly extended through a face of the main bar 30 for hanging items such as keys 63 thereon, as shown in FIGS. 1, 4 and 5.

The attachment means of the central container assembly 2 may comprise an opening, for example, defined by a socket 25, for receiving a lower portion of the main bar 30 of the hanging post assembly 3. As shown in FIGS. 1, 2 and 4, a block portion 34 may protrude from a middle portion of the main bar 30 for retaining a suitable position of the hanging post assembly 3 relative to the receiving opening of said attachment means.

Figure 5:
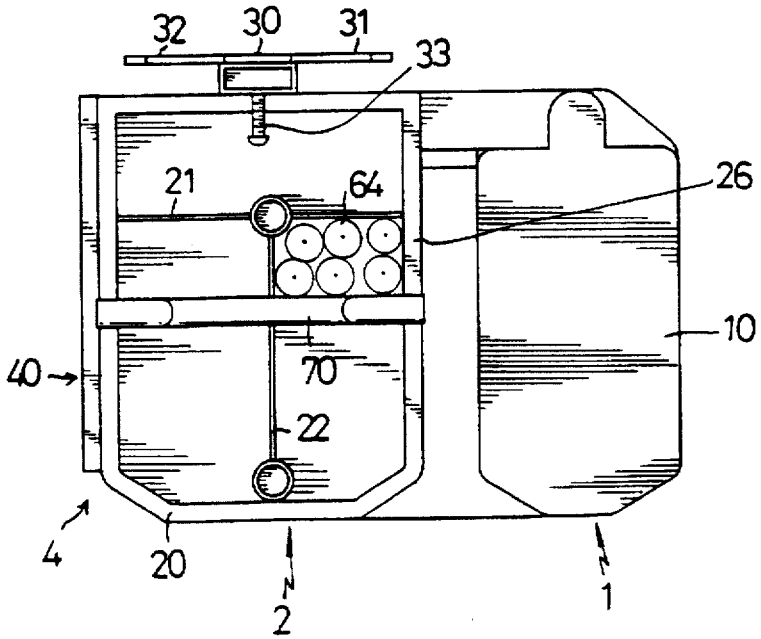
FIG. 5 is a top view of the present container combination for stationery goods.

The central container assembly 2 may further comprise a movable support crossbar 70 on its top assembling frame 20 for support writing instruments 64 and other stationery goods up-ended, as shown in FIG. 5. Please refer to FIGS. 1 and 2, the movable support crossbar 70 may comprise two legs 71, 73 on each of two opposite ends 72 thereof bridging a side wall of the top assembling frame 20 such that it can slide on the edges of two opposite side walls.

The assembling frame 20 may further comprise at least one separating plate therein such that there will be more than one cavity separated by the plate. In the present embodiment, there are three separating plates 21, 22 and 23. The separating plates may intersect with each other. Also, the separating plates 21, 22 and 23 may be connected between the side walls and the jointing means.

As can be seen in FIGS. 1, 2 and 3, the lateral container assembly 1 includes a plurality of containers 13, 132 stacked up on the base plate 50 besides the central container assembly 2 for receiving erasers, paper clips, staples and other stationery goods therein. These containers each have an open top. The containers may take any shape, for example, a rectangle, or a polygon, etc. Each of the containers comprises pivoting means for stacking up on and pivoting with another one. The pivoting means of each container except the bottom container 132 may comprise a hollow lug 14 defining a receiving hole therein and a plug 15 protruding downwardly from a bottom of the hollow lug 14 for being received in a receiving hole of a container beneath it so that the containers may pivot around an axis perpendicular to the base plate 50. The pivoting means of the bottom container 132 has a hollow lug 14 defining a receiving hole therein but has no protrusion on the bottom thereof. The bottom container can be attached to the base plate by means commonly known to persons skilled in the art. Also, the bottom container 132 may be formed integral with the base plate 50, as shown in FIG. 8.

The lateral container assembly 1 may further comprise an enclosure lid 10 on its top container. The enclosure lid 10 may comprise pivoting means on a bottom face thereof and near one edge thereof. This pivoting means may be receivable in and pivotable around the receiving hole of the top container. The pivoting means of said enclosure lid 10 may comprise a plug 12 protruding downwardly from a bottom face of the enclosure lid 10 for pivoting in the receiving hole in the top container 13.

There may exist a space (defined by distance L1 in FIG. 1) between the central container assembly 2 and the lateral container assembly 1 for placing paper such as letter paper or note paper therein, as shown by the phantom line in FIG. 1.

As can be seen in the drawing FIGS. 1, 2 and 3, the lateral container assembly 1 and the bookend assembly 4 may be provided on opposing sides of the central container assembly. However, the relative positions of the bookend assembly 4, the central container assembly 2, and the lateral container assembly 1 can be arranged in other ways.

The bookend assembly 4 may include and L-shaped movable plate 40 having a vertical portion 401 and a horizontal portion 402. The base plate 50 may include receiving means, for example, a receiving recess 44, in its bottom for receiving the horizontal portion 402 of the bookend assembly 4, as shown in FIGS. 3 and 4. A spring means commonly known to persons skilled in the art, for example, a coil spring 42 may be disposed between the horizontal portion 402 and the base plate 50 for biasing the vertical portion 401 of the movable plate 40 toward an edge of the base plate 50. If a side wall of the central container assembly 2 is flush with (as shown in FIGS. 1, 4 and 5) or extended over an edge of the base plate 50, the vertical portion 401 may abut the central container assembly 2. As shown in FIG. 3, books 61 of different sizes can be placed on the horizontal portion 402 of the bookend assembly 40 between the vertical portion 401 and a side wall of the central container assembly 2.

Figure 7:
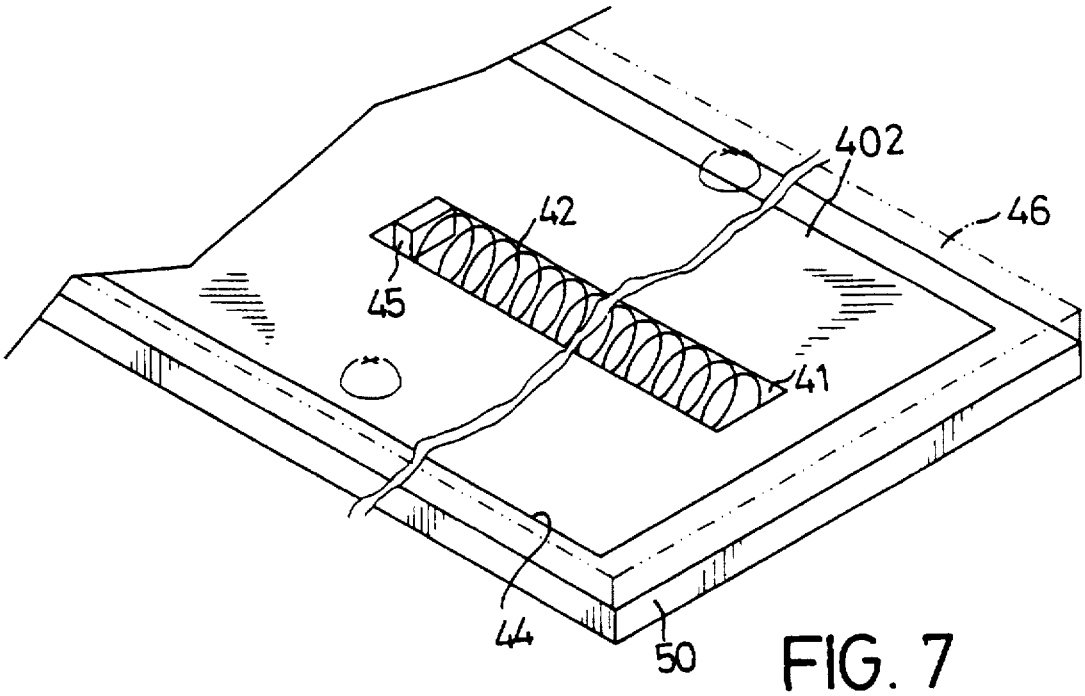
FIG. 7 is segmental perspective view from the bottom side of the base plate of the present container combination for stationery goods.

The receiving recess 44 of the base plate 50 may further comprise a stop block 45 projecting therefrom and at the same time the horizontal portion 402 of the movable plate 40 may further comprise a slot 41 for receiving the stop block 45 such that the spring means is disposed in the slot between the stop block 45 and an end of the slot 41. The base plate 50 may further comprise a bottom plate 46 attached to its bottom by fastening means commonly known to persons skilled in the art, for example, a plurality of screws 47 for slidably securing the horizontal portion 402 of the movable plate 40 in the receiving recess 44. The arrangement of the spring means after assembling can be best seen in FIG. 7, which is a segmental perspective view from the bottom side of the base plate with the bottom plate 46 shown in phantom lines.

FIG. 8 is a perspective view of another embodiment of a container combination for stationery goods in accordance with the present invention. In the embodiment, the central container assembly 2 and the lateral container assembly 1 is made integral with the base plate 50.

It will be apparent to those skilled in the art that many modifications and variations may be made in the embodiments which have been described in detail without departing from the spirit or scope of the present invention.

I claim:

1. A container combination for stationery goods, comprising:

a base plate having receiving means on a bottom thereof;

a central container assembly provided on the base plate and including a first assembling frame abutting the base plate and at least one second assembling frame stacked up on the first assembling frame, each of the first and second assembling frames having top and bottom openings therein and having at least one joint means therein, at least one of these assembling frames having attachment means on a rear side wall thereof;

a lateral container assembly provided on the base plate adjacent to one side of the central container assembly and including a first container abutting the base plate and at least one second container stacked on the first container, each of the first and second containers having an open top and having pivoting means on a rear side wall thereof for pivoting with other containers around an axis perpendicular to the base plate;

a bookend assembly provided on the base plate adjacent to another side of the central container assembly and including an L-shaped movable plate having a vertical portion and a horizontal portion received in the receiving means of the base plate, and spring means disposed between the horizontal portion and the base plate for biasing the vertical portion of the movable plate toward an edge of the base plate; and a post assembly for hanging articles thereon including a main bar having a lower portion attachable to the central container assembly by the attachment means, and at least one hook on an upper portion of the main bar.

2. A container combination as claimed in claim 1, wherein the joint means of each of the first and second assembling frames comprises a ring portion defining a receiving hole therein, the jointing means of the second assembling frame further comprising a plug protruding downwardly from a bottom of the ring portion, the plug of an upper one of the assembling frames being receivable in the receiving hole of an adjacent lower one of the assembling frames;

the attachment means of the central container assembly comprises an opening for receiving a lower portion of the main bar of the hanging post assembly;

the pivoting means of each of the first and second container comprises a hollow lug defining a receiving hole therein, the pivoting means of the second container further comprising a plug protruding downwardly from a bottom of the hollow lug, the plug of an upper one of the containers being receivable in and pivotable around the receiving hole of an adjacent lower one of the container;

the receiving means of the base plate comprises a recess for receiving the horizontal portion of the L-shaped movable plate; and the spring means of the bookend assembly comprises a coil spring.

3. A container combination as claimed in claim 2, wherein the first container of the lateral container assembly is integral with the base plate.

4. A container combination as claimed in claim 2, wherein the first assembling frame of the central container assembly is integral with the base plate.

5. A container combination as claimed in claim 2, wherein the lateral container assembly further comprises an enclosure lid on its top container.

6. A container combination as claimed in claim 5, wherein the enclosure lid comprises near a bottom edge thereof pivoting means receivable in and pivotable around the receiving hole of the top container.

7. A container combination as claimed in claim 6, wherein the pivoting means of the enclosure lid comprises a plug protruding downwardly from a bottom face of the enclosure lid for pivoting in the receiving hole on the top container.

8. A container combination as claimed in claim 2, wherein the central container assembly further comprises a movable support crossbar on its top assembling frame.

9. A container combination as claimed in claim 8, wherein the movable support crossbar comprises two legs on each of two ends thereof bridging a side wall of the assembling frame for sliding on edges of the side walls.

10. A container combination as claimed in claim 2, wherein a space exists between the central container assembly and the lateral container assembly.

11. A container combination as claimed in claim 2, wherein the lateral container assembly and the bookend assembly are provided on opposing sides of the base plate.

12. A container combination as claimed in claim 2, wherein the assembling frame further comprises at least one separating plate therein.

13. A container combination as claimed in claim 12, wherein the at least one separating plate comprises a plurality of separating plates intersecting with each other.

14. A container combination as claimed in claim 2, wherein the main bar of the hanging post assembly further comprises a block portion protruding from its middle portion for retaining a suitable position of the hanging post assembly relative to the receiving opening of the attachment means.

15. A container combination as claimed in claim 14, wherein the main bar of the hanging post assembly further comprises a screw extending partly therethrough.

16. A container combination as claimed in claim 2, wherein the receiving recess of the base plate further comprises a stop block projecting therefrom and the horizontal portion of the movable plate further comprises a slot for receiving the stop block such that the coil spring is disposed in the slot between the stop block and an end of the slot; and the base plate further comprises a bottom plate attached to it bottom by fastening means for slidably securing the horizontal portion of the movable plate in the receiving recess.

17. A container combination as claimed in claim 16, wherein the fastening means comprises a plurality of screws.

* * * * *